US005271196A

United States Patent [19]

Fanti

[11] Patent Number: 5,271,196

[45] Date of Patent: Dec. 21, 1993

[54] STABILIZER RETENTION DEVICE FOR BEACH UMBRELLAS

[76] Inventor: Roy Fanti, 171 Atwater Rd., Springfield, Mass. 01107

[21] Appl. No.: 806,339

[22] Filed: Dec. 13, 1991

[51] Int. Cl.[5] ..... E02D 5/74

[52] U.S. Cl. ..... 52/166; 52/165; 135/16; 248/530; 248/156

[58] Field of Search ..... 52/165, 166; 248/545, 248/530, 156, 910

[56] References Cited

U.S. PATENT DOCUMENTS

| | | | |
|---|---|---|---|
| 221,536 | 11/1879 | Dean | 52/166 |
| 2,554,887 | 5/1951 | Tricarico | 248/156 |
| 2,628,797 | 2/1953 | Campomar . | |
| 2,923,449 | 2/1960 | Sund . | |
| 3,289,363 | 12/1966 | Patch . | |
| 3,570,795 | 3/1971 | Benzel | 248/156 |
| 3,823,785 | 7/1974 | Toliver | 248/156 |
| 3,879,065 | 4/1975 | Kobayashi | 285/162 |
| 4,497,077 | 2/1985 | Provost | 248/156 |
| 4,753,411 | 6/1988 | Lechner et al. . | |
| 4,834,127 | 5/1989 | Van Sice | 403/298 |
| 4,850,564 | 7/1989 | Padin | 248/545 |
| 4,972,642 | 11/1990 | Strobl | 52/165 |
| 5,044,323 | 9/1991 | Papak | 248/156 |

*Primary Examiner*—Henry E. Raduazo

*Attorney, Agent, or Firm*—Jacobson, Price, Holman & Stern

[57] ABSTRACT

A stabilizer-retention device for beach umbrellas which will substantially increase the total static retention forces and lateral stability of beach umbrellas thereby alleviating or preventing lifting forces caused by steady winds and/or gusts causing a beach umbrella to become dislodged from the sand in which it is supported or becoming tilted or upset thereby greatly facilitating use of beach umbrellas in a more stable, secure and safe manner. The device involves an attachment or modification of the supporting rod or standard that is normally inserted into the sand to increase the lateral stability and static retention of the umbrella. Various embodiments of the device are disclosed including a plate attached to the lower end of the supporting rod which may be circular, square or polygonal with various methods of attachment or an open-topped container embedded in the sand for receiving the beach umbrella rod or standard. The plate attached to the lower end of the supporting rod or standard can be used as a digging implement to facilitate excavation of a vertical cavity in the sand in which to place the plate-like structure at the lower end of the beach umbrella supporting rod or standard.

3 Claims, 2 Drawing Sheets

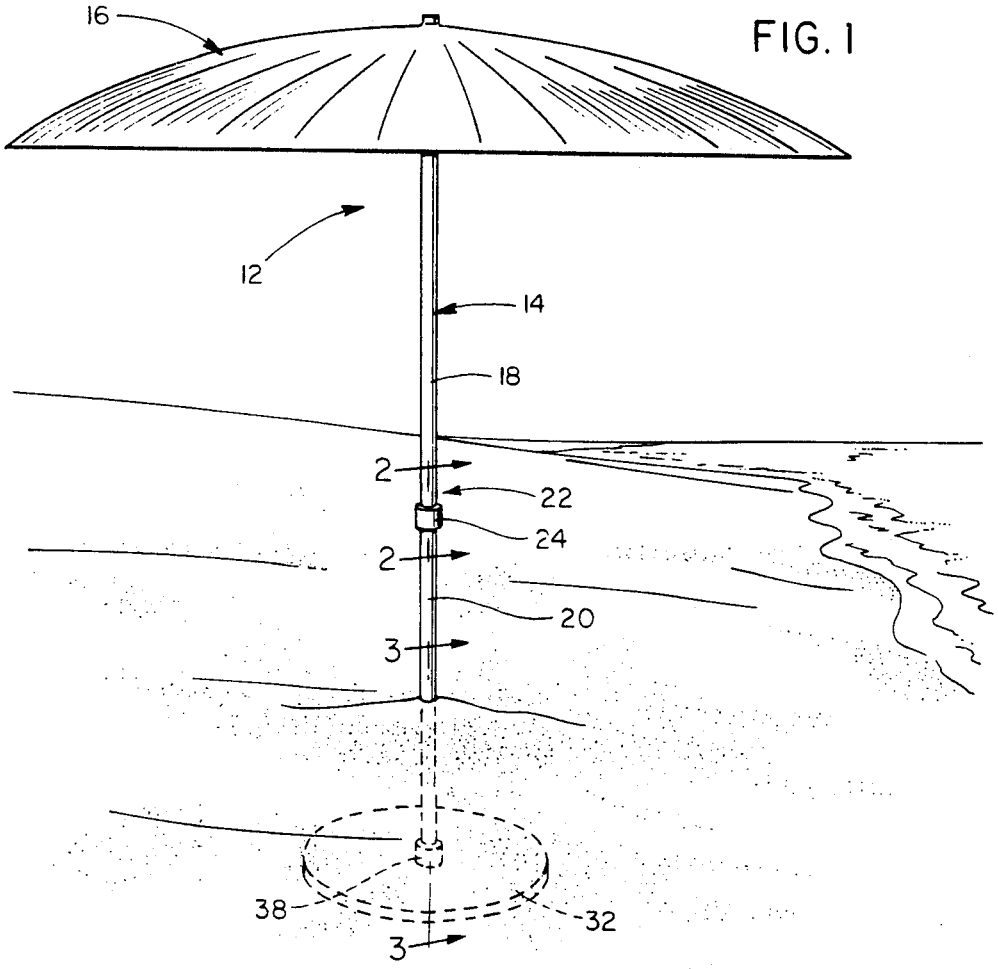
FIG. 1
FIG. 2
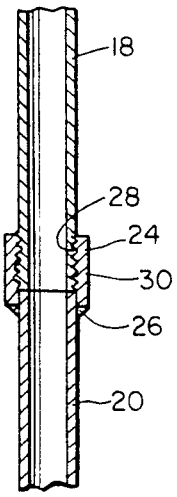
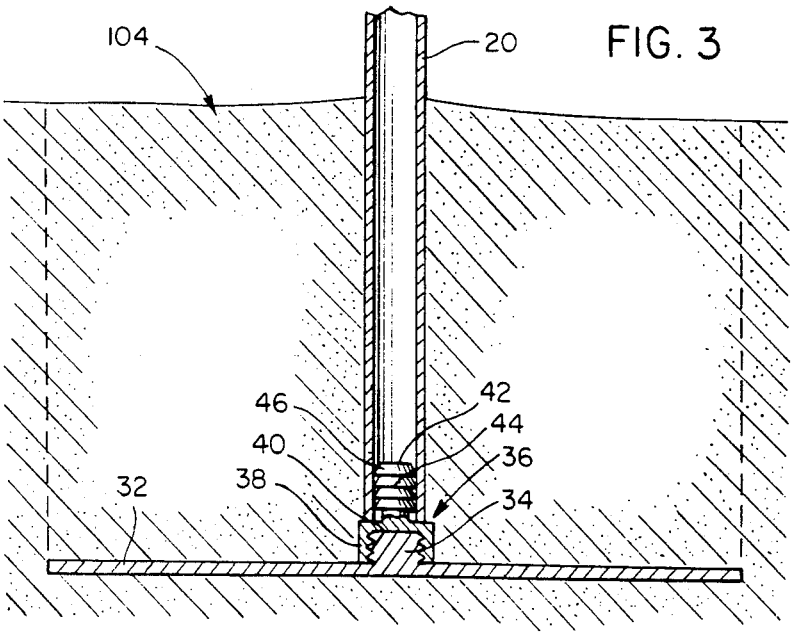
FIG. 3

STABILIZER RETENTION DEVICE FOR BEACH UMBRELLAS

BACKGROUND OF THE INVENTION

1. Field of the Invention

The present invention generally relates to improvements in beach umbrellas and more particularly a stabilizer-retention device for beach umbrellas which will substantially increase the total static retention forces and lateral stability of beach umbrellas thereby alleviating or preventing lifting forces caused by steady winds and/or gusts causing a beach umbrella to become dislodged from the sand in which it is supported or becoming tilted or upset thereby greatly facilitating use of beach umbrellas in a more stable, secure and safe manner. The device involves an attachment or modification of the supporting rod or standard that is normally inserted into the sand to increase the lateral stability and static retention of the umbrella. Various embodiments of the device are disclosed including a plate attached to the lower end of the supporting rod which may be circular, square or polygonal with various methods of attachment or a generally cylindrical open-topped container embedded in the sand for receiving the beach umbrella rod or standard. The plate attached to the lower end of the supporting rod or standard can be used as a digging implement to facilitate excavation of a vertical cavity in the sand in which to place the plate at the lower end of the beach umbrella supporting rod or standard.

2. Description of the Prior Art

Beach umbrellas are frequently employed to provide an area of shade or shelter to protect beach goers from direct sun rays and provide a somewhat protected area for various paraphernalia used by beach goers. Conventional beach umbrellas include an elongated rigid standard with a pointed lower end which is embedded into the sand by exerting a downward force on the standard while moving the standard back and forth in an angular manner. However, lifting forces of the wind, wind gusts or subsequent pivotal movement of the umbrella frequently results in the umbrella being upset and/or completely dislodged from the sand. This can result in a hazardous condition since the wind, after dislodging the umbrella, will cause it to roll or tumble along the beach surface causing an extremely dangerous situation for other beach goers.

Various procedures have been developed for more securely anchoring beach umbrellas in place such as using heavy bases which are difficult and heavy to carry to the beach. Also, a screw auger type of anchor has been provided which is rather difficult to properly install in view of the rotational torque which must be exerted in order to properly install the auger type anchoring device. The following U.S. patents relate to this field of endeavor:

U.S. Pat. No. 2,628,797
U.S. Pat. No. 2,923,449
U.S. Pat. No. 3,289,363
U.S. Pat. No. 4,753,411

While efforts have been made to more securely support beach umbrellas, the prior art does not include a disclosure of a plate-like structure attached to the lower end of the beach umbrella standard by various attaching arrangements in which the plate-like structure can either be a flat plate or a container-like structure which is embedded in a cavity in the sand in which the cavity has substantial depth to enable a substantial quantity of sand to be placed on top of the plate-like structure to anchor the plate-like structure and thus the standard and the beach umbrella in a secure and safe manner.

SUMMARY OF THE INVENTION

An object of the present invention is to provide a stabilizer-retention device for beach umbrellas in the form of an attachment to or modification of the support rod or standard of a beach umbrella which results in a significant increase in the stability and retention of the beach umbrella with the attachment or modification including the provision of a plate-like structure on the lower end of the support rod or standard which is placed in a cavity of requisite horizontal and vertical dimensions to enable the plate-like structure to be positioned in the cavity at a substantial depth below the surface of the sand with the cavity the being filled with the weight of the sand engaging the plate-like structure providing increased static retention forces and lateral stability characteristics to the beach umbrella supporting rod or standard.

Another object of the invention is to provide a stabilizer-retention device in which the plate-like structure is a generally flat plate of circular or polygonal configuration attached to the lower end of the support rod or standard by unique structure with the plate being capable of use with the lower portion of the support rod or standard in excavating a cavity in the sand by using the plate and lower portion of the support rod or standard as a digging implement.

A further object of the invention is to provide a stabilizer-retention device for beach umbrellas in which the plate-like structure is in the form of a generally cylindrical container with an imperforate bottom and radial reinforcing webs supporting a central tubular member for receiving and securely anchoring the lower end of the support of rod or standard of the beach umbrella.

Still another object of the present invention is to provide a beach umbrella having a support rod or standard constructed of detachable but rigidly connected upper and lower components to enable the support rod or standard to be more easily transported to a site of use and enabling the lower portion of the support rod or standard to be used in conjunction with the plate-like structure to form a cavity or recess in the sand in which to install the beach umbrella with the stabilizer-retention device of the present invention connected thereto.

A still further object of the invention is to provide a stabilizer-retention device for beach umbrellas which is simple in construction, effective in securely and safely anchoring a beach umbrella in place in the sand and dependable and easy to use thereby facilitating its use by all types of beach goers.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of a beach umbrellas of the present invention with the stabilizer-retention device attached thereto and illustrating the detachable connection between the upper portion and lower portion of the support rod or standard of the beach umbrella.

FIG. 2 is a vertical sectional view, on an enlarged scale, taken substantially upon a plane passing along section 2-2 on FIG. 1 illustrating further structural details of the joint between the upper and lower portions of the support rod or standard.

FIG. 3 is a vertical section view, on an enlarged scale, taken along section line 3—3 on FIG. 1 illustrating the structural arrangement of the stabilizer/retention device and its association with the sand forming the beach.

DESCRIPTION OF THE PREFERRED EMBODIMENTS

Figure 4:
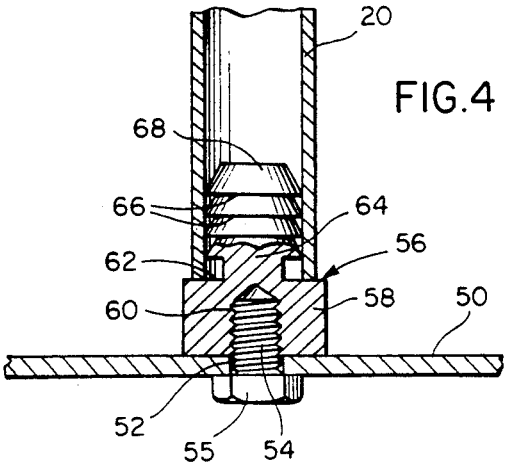
FIG. 4 is an enlarged sectional view illustrating a connecting arrangement between the anchoring plate-like structure and the supporting rod or standard.

Referring now specifically to the drawings, a beach umbrella incorporating the present invention therein is generally designated by reference numeral 12 and includes a vertical support rod, pole or standard generally designated by reference numeral 14 and which may be of solid rod-like construction or of tubular construction. At the upper end of the support rod 14, a canopy 16 of canvas, fabric or the like is mounted in a conventional manner with ribs and actuating rods connected with a sleeve on the support rod to enable the canopy 16 to fold to a collapsed position or extend to an operative position as illustrated in FIG. 1. All of this portion of the beach umbrella is conventional.

The support rod or standard 14 includes an upper portion 18 and a lower portion 20 connected by a coupling 22 which enables the support rod or standard to be separated into two components and posit of each other for ease of carrying and storing, as conventional done FIG. 2 illustrates the specific coupling 22 which involves an internally threaded cylindrical fitting 24 rigidly affixed to the lower portion 20 of the support rod 14 by welding or other rigid connection means designated by reference numeral 26. The lower end of the upper portion 18 of the support rod or standard 14 is externally threaded as at 28 to engage the internal threads 30 on the coupling fitting 24 thus providing a screw threaded, detachable but secure connection between the portions 18 and 20 of the support rod or standard 14 with the end edges of the portions 18 and 20 abuttingly engaging each other when properly assembled thereby providing a rigid coupling 22 to provide a rigid support rod or standard 14.

In conventional umbrella support rods or standards, the lower end of the support rod is tapered to a point to facilitate its insertion in the sand. In the present invention, a plate-like structure in the form of a circular plate or disk 32 is connected to the lower end of the lower portion 20 of the support rod or standard 14. A secure and rigid connection is provided between the plate 32 and the lower portion 20 of the support rod or standard 14 with this connection including an upstanding centrally disposed, externally threaded projection 34 on the plate 32. An adaptor 36 is connected to the projection 34 and extends internally of the lower tubular end of the lower portion 20 of the support rod or standard 14. The adaptor 36 includes a lower cylindrical portion 38 which is internally threaded for screw threaded engagement with the externally threaded projection 34. The upper end of the cylindrical member 38 is provided with a horizontal imperforate member 40 having a centrally disposed upwardly extending projection 42 thereon which telescopes into the lower portion 20 of the support rod or standard 14. The projection 42 is provided with a plurality of peripheral ribs or flanges 44 having a downwardly and outwardly inclined upper surface 46 which are dimensioned to be forced into or driven into the interior of the hollow tube defining the lower end of the lower portion 20 of the support rod or standard 14 thus rigidly and fixedly anchoring the adaptor 36 to the lower portion 20 of the support rod or standard.

FIG. 4 illustrates another embodiment of the invention in which an anchoring plate 50 is provided with a centrally disposed aperture or opening 52 receiving an externally threaded bolt 54 therethrough having a polygonal head 55 on its lower end which engages the bottom surface of the plate 50. An adaptor 56 interconnects the bolt 54 and the lower portion 20 of the support rod or standard 14. The adaptor 56 includes a bottom member 58 having an internally threaded bore 60 which is engaged with the threaded bolt 54 to anchor the adaptor 56 to the anchor plate 50. The upper surface of the bottom member 58 is radially disposed at 62 and forms an abutment for engaging the lower end of the lower portion 20 of the support rod or standard 14. The center of the adaptor 56 is provided with a projection 64 which extends upwardly into the tubular lower end of the lower portion 20 with ribs or flanges 66 having inclined upper surfaces 68 being formed on the external periphery of the projection 64 with the ribs or flanges 66 securely anchoring the adaptor 56 to the lower portion 20 of the beach umbrella support rod or standard 14.

Figure 5:
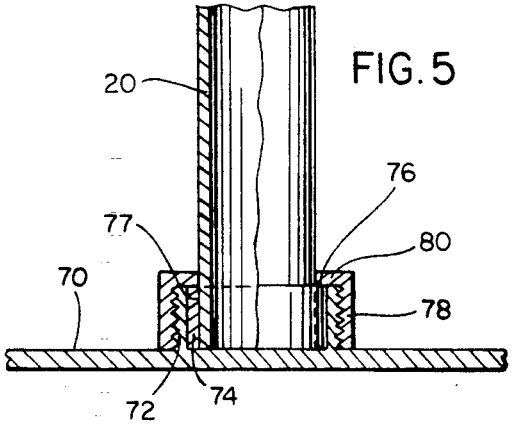
FIG. 5 is a sectional view similar to FIG. 4 but illustrating another embodiment of the connection between the support rod or standard and the anchoring plate.

FIG. 5 illustrates another embodiment of the connection between the anchor plate and the support rod or standard which includes a plate 70 having an externally threaded sleeve 72 rigidly affixed to the center thereof. The lower portion 20 of the support rod or standard 14 extends internally of the sleeve 72 and abuts the upper surface of the plate 70 and is provided with a compressible peripheral sleeve 74 affixed thereto which defines an upwardly facing peripheral shoulder 76 and an inner cylindrical surface 77 that is in intimate bearing contact with the lower portion 20. An internally threaded retaining cap or sleeve 78 is in screw threaded engagement with the threaded sleeve 72 with the upper end of the cap 78 including an interned flange 80 which overlies and engages the shoulder 76 defined by the sleeve 74 thereby compressing 74 to produce a strong, friction-type locking bond with the lower portion 20 thus providing a secure but detachable connection between the support rod or standard 14 and the plate 70.

Figure 6:
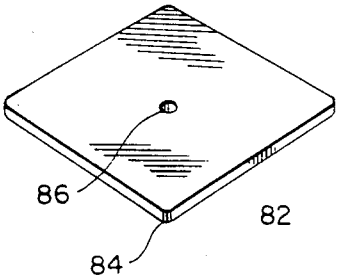
FIG. 6 is a perspective view of an anchor plate of square configuration which can be used in lieu of the circular plate illustrated in FIG. 1.

FIG. 6 illustrates an alternative plate structure which in this instance is a square plate 82 having rounded corners 84 for safety purposes and a central aperture 86 to function in the nature of the structure illustrated in FIG. 4. The plates 32, 50 and 70 may also be constructed of square, rectangular or polygonal configuration of metal or plastic material.

Figure 7:
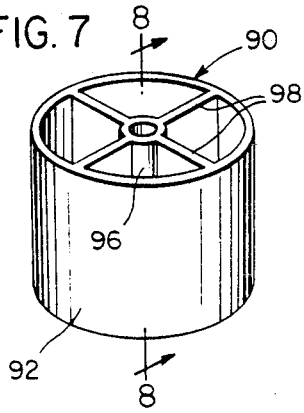
FIG. 7 is a perspective view of a generally cylindrical container forming the plate-like structure which anchors the support rod or standard in place.
Figure 8:
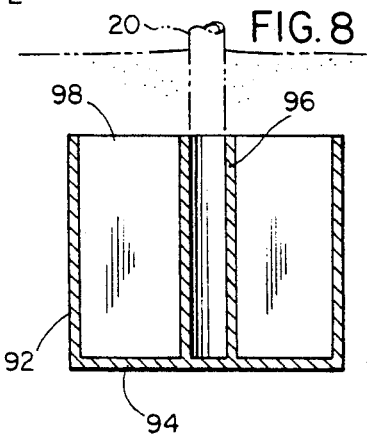
FIG. 8 is a vertical sectional view taken substantially upon a plane passing along section line 8—8 on FIG. 7 illustrating the relationship of this embodiment of the invention to the sand.

FIGS. 7 and 8 illustrate another embodiment of the anchoring device generally designated by reference numeral 90 which includes a cylindrical container or canister 92 provided with an imperforate bottom wall 94 and a central vertically disposed sleeve 96 rigidified in relation to the cylindrical container or canister 92 by a plurality of radial reinforcing webs 98. The vertically disposed central sleeve 96 forms a socket for telescopically receiving and securely anchoring the lower end portion 20 of the support rod or standard of the umbrella. All of the anchoring devices, plate-like structures and containers are positioned below the surface 100 of the beach sand 102 with a predetermined volume of sand generally designated by reference numeral 104 overlying the anchor device or received therein as in the case of the embodiment illustrated in FIG. 7 and 8 to provide a stabilizing-retention force to the umbrella assembly in a manner described in more detail hereinafter.

Figure 9:
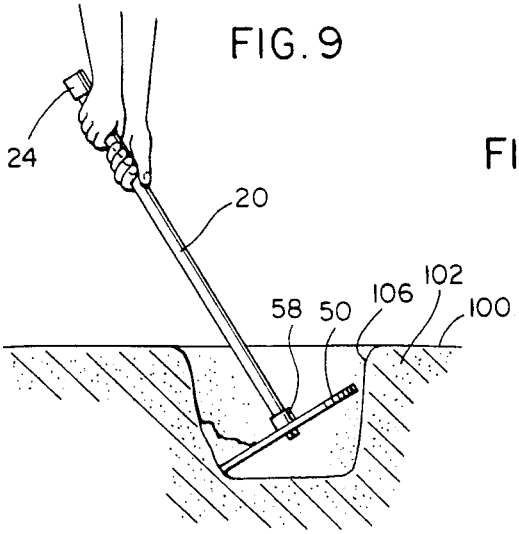
FIG. 9 is an elevational view illustrating the manner in which the plate at the lower end of the lower portion of the support rod or standard can be used as a digging implement to form a cavity in the sand.
Figure 10:
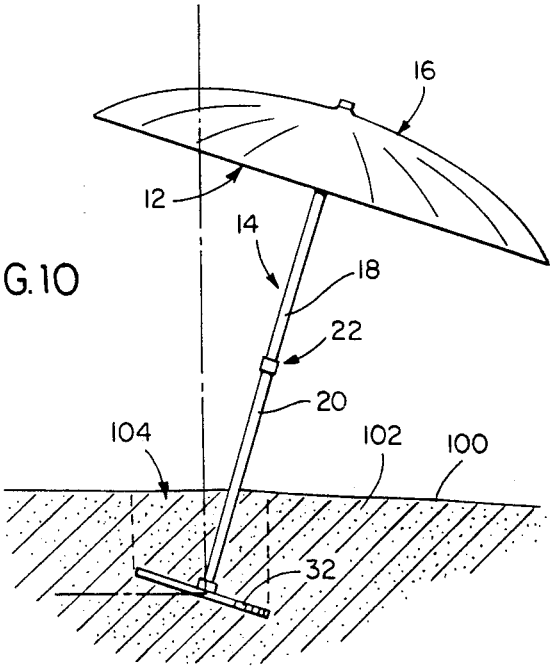
FIG. 10 is an elevational view illustrating how the plate on the lower end of the umbrella supporting rod or standard can be oriented in a sand cavity to position the umbrella in a desired angular position to facilitate its use as a shelter or protection from the rays of the sun.

FIG. 9 illustrates the manner of using the lower portion 20 and one of the anchor plates such as plate 50 to form an enlarged cavity 106 in the sand 102 by using the combined plate 50 and lower portion 20 as a digging implement similar to a hoe which can be used in a manner to remove sand material to form the cavity 106. Once the cavity has been formed, the plate is positioned therein and a volume of sand 104 placed on the plate as shown in FIGS. 1 and 10 to completely fill the cavity to provide an effective stabilizer-retention force to retain the umbrella assembly in place in the sand in either a vertical position or angled position.

As indicated previously, the unique modification to beach umbrellas of this invention results in a significant increase in the stability and retention of beach umbrellas when the support rod, pole or standard is embedded in the sand. The stabilizer-retention device as disclosed herein provides an arrangement that is inherently more stable and safer as compared to conventional beach umbrellas and effectively protects beach goers from the hazards that occur when conventional beach umbrellas are upset, pulled out of the sand and blown down the beach in a tumbling or rolling action due to the lifting forces generated by steady or gusting winds.

As is well known, conventional beach umbrellas are rather difficult to embed into the sand which usually results in an insecure and unsafe engagement of the beach umbrella support rod with the sand with this unstable and insecure support of the beach umbrella resulting in upsetting actions of the wind, wind gusts or due to physical manipulations of the umbrella by the user in an effort to change the location of the shaded area in response to the variation in the angle of direction of the sun's rays during the day.

When a beach umbrella is embedded into the sand, only two principle restraining forces anchor or keep the umbrella in place against the action of the upsetting wind forces. The primary force is a static restraining force equal to the weight of the umbrella when the umbrella is mounted in a vertical position. If the umbrella is tilted at an angle to the vertical then a reduced vector component of this weight is directed downwardly along the angled lower support column that is embedded into the sand with this force becoming the static resistive or static reactive supporting force that opposes any lifting force on the umbrella generated by wind action which tends to dislodge the supporting rod or standard from the stand. Thus, the maximum static resistive force for conventional beach umbrellas is never greater than the total weight of the umbrella and its associated assembly parts.

A secondary resistive force occurs when the conventional beach umbrella starts to rise out of its sand mounting which force results from a drag or friction force acting along the peripheral surface of that portion of the supporting rod, pole or standard that remains in intimate contact with the retentioned sand. This dynamic resistive force is small in magnitude and is little or no consequence as a restraining force when compared to the static resistive force attributable to the weight of the conventional umbrella.

It should be noted that when a conventional beach umbrella is aligned at an angle to the vertical, a vector component of the total weight of the umbrella acting through the effective center of gravity of the umbrella and directed perpendicular to the supporting rod or pole produces an upsetting mechanical moment or force times distance that tends to rotate the upper end of the umbrella towards the ground. In order for the umbrella to remain stable and not topple over, an equal and opposite reaction force and moment must be provided in the area where the lower pole of the umbrella is cantilevered into the sand. However, sand provides little or minimum restoring action to any applied torque due to its poor shearing resistance characteristics. Thus, an unstable situation results in which the umbrella rotates even further away from a vertical position. Since a lifting force due to wind which is required to raise the conventional type of umbrella out of its retention hole decreases significantly as the orientation angle increases, it is important that a conventional umbrella be retained in a near vertical orientation. However, even with a vertical orientation, the conventional beach umbrella will rise out and become dislodged in relation to the sand retention if the lifting force on the umbrella exceeds by a small amount the weight of the umbrella and the upsetting wind lifting force can be considerably less than the weight of the conventional umbrella if the umbrella is oriented at a large angle from the vertical. All of these considerations point out the fact that the maximum restraining force of a conventional beach umbrella in opposition to the lifting action of the wind to prevent the umbrella from becoming free from its retention in the sand is limited to approximately the weight of the conventional umbrella. Thus, once the magnitude of force is exceeded by the wind lifting force, the conventional umbrella will become dislodged in a sudden and quick manner and be blown away or tumbled which results in a hazardous situation that may endanger or seriously injure other beach goers who happen to be in the path of wayward movement of the umbrella.

In distinction to conventional beach umbrellas, the unique stabilizer-retention device of this invention makes the beach umbrella much more stable and inherently safer for protecting other beach goers from possible injury or endangerment.

A prototype model was made and tested with the prototype including a stabilizer plate mounted to the lower end of the lower support rod. In these tests, two separate holes of only 8" depth were dug into the sand. The lower support pole of a conventional beach umbrella was installed in one hole and firmly embedded into the sand by filling and compacting the sand around the pole which was oriented in a vertical position. In the other hole, the lower support rod of the prototype model had a 7" diameter circular plastic disk mounted at its lower end which was placed in the hole and embedded into the sand in a similar manner by filling the cavity with sand. Thus, the prototype model had a column of sand over the disk, such as indicated by reference numeral 104 in FIG. 3, with the column of sand having a calculated volume equal to the net base area of the circular disk times the height that it was embedded below the prevailing sand surface. This net volume times the density of the sand provides a substantial downward force, equal to the weight of the sand, acting to retain the prototype beach umbrella from lifting out of its mounting in the sand.

In the test, it was immediately noted that the conventional beach umbrella, which in this instance weighed 7 lbs., was only tentatively stable. In fact, tilting the conventional beach umbrella at a small angle of approximately 15° from vertical caused the umbrella to fall to the ground even though the wind velocity was low as soon as a supporting hand was removed from its supporting pole. Obviously, for this particular conventional umbrella, a deeper retention hole would have been required in an attempt to alleviate this deficiency. After reembedding the conventional beach umbrella into the sand, a vertical lifting force was applied to the support rod by hand and it was noted that the conventional umbrella easily lifted out of its mounting hole when a force approximate to 7 lbs. lifting force equal to the weight of the umbrella was applied. This will also approximate the wind lifting force necessary to upset or dislodge the conventional beach umbrella.

By comparison, the prototype model remains stable even when the umbrella was tilted from vertical to an angle in excess of 30°. Further, it was extremely difficult to lift the prototype model vertically out of the sand by applying an upward force on the support rod or pole. As a comparison, the conventional 7 lb. umbrella had a total static retention force of 7 lbs. when the umbrella was vertical. The prototype with the disk when in 8" of sand had a total static retention force of 31.8 lbs. when in vertical position thereby providing a total static retention force that is several 100% greater than that of a conventional beach umbrella. Clearly, by using various sizes of disks and sand cavities of different depths, various static retention forces can be obtained all of which are substantially more than the retention force provided by a conventional beach umbrella, and under certain usage yields improvements of approximately 1–2 thousand percent. The attached comparison tables 1–5 illustrate actual retention force increase obtained from the embodiments of this invention as compared with the retention force of a standard-type beach umbrella system.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

As shown in Table 1, the total static retention force on the standard-type beach system, as a function of its orientation with respect to the vertical, may be calculated by the relationship Wcosine $\theta$, where W is the weight of the said umbrella system and $\theta$ is its angle deviation from the vertical. Table 1a and 1b show these values for both a 4 lb and a 7 lb standard-type beach umbrella system. Note that contrary to what the general beach-goer may think, these total static retention values are independent of the depth that the said umbrella system is embedded into the stand. The depth is primarily significant in providing a lateral stability to the standard type beach umbrella system.

TABLE 1

| STANDARD-TYPE UMBRELLA | | | |
|---|---|---|---|
| (a) | | (b) | |
| $\theta$ | TOTAL STATIC RETENTION FORCE 4 lb UMBRELLA | $\theta$ | TOTAL STATIC RETENTION FORCE 7 lb Umbrella |
| 0° | 4 lbs | 0° | 7 lbs |
| 30° | 3.5 lbs | 30° | 6.1 lbs |
| 45° | 2.8 lbs | 45° | 4.9 lbs |
| 60° | 2 lbs | 60° | 3.5 lbs |

In comparison, with the embodiments of this invention both the shape of the stabilizer-retention disk attached to the lower support pole and the depth that the said disk is buried beneath the surface of the sand contribute markedly to the total static retention force resisting the upsetting lifting force caused by the wind. This is illustrated by reference to the calculated results shown in TABLE 2 for a 7" circular disk type stabilizer-retention device, and in TABLE 3 for an essential square 7" by 7" type stabilizer retention device, respectively for both a 4 lb and 7 lb beach umbrella system.

TABLE 2

| | USING 7" DIA CIRCULAR-TYPE STABILIZER | | | |
|---|---|---|---|---|
| DEPTH IN SAND | TOTAL STATIC RETENTION FORCE | % INCREASE OVER STANDARD-TYPE UMBRELLA SYSTEM | TOTAL STATIC RETENTION FORCE | % INCREASE OVER STANDARD-TYPE UMBRELLA SYSTEM |
| 8" | 28.8 lbs | 720% | 31.8 lbs | 454% |
| 10" | 35.0 lbs | 875% | 38.0 lbs | 542% |
| 12" | 41.3 | 1033% | 44.3 lbs | 633% |

a) 4 lb SYSTEM, $\theta$ = 0°
b) 7 lb SYSTEM, $\theta$ = 0°

TABLE 3

| DEPTH IN SAND | USING 7" × 7" SQUARE-TYPE STABILIZER WITH ROUNDED EDGES | | | |
|---|---|---|---|---|
| | TOTAL STATIC RETENTION FORCE | % INCREASE OVER STANDARD-TYPE UMBRELLA SYSTEM | TOTAL STATIC RETENTION FORCE | % INCREASE OVER STANDARD-TYPE UMBRELLA SYSTEM |
| 8" | 35.9 lbs | 898% | 38.9 lbs | 556% |
| 10" | 43.8 lbs | 1095% | 46.8 lbs | 669% |
| 12" | 52.8 lbs | 1320% | 55.8 lbs | 797% |

a) 4 lb SYSTEM. $\theta = 0°$
b) 7 lb SYSTEM. $\theta = 0°$

As seen from comparison of Tables 2 and 3, the square-type stabilizer disk with a side dimension equal to the diameter of a circular type-disk always has the greater total static retention force. Also it is apparent that the deeper the disk, of either type, is buried below the sand surface, the larger is the magnitude of this retention force. Furthermore, of significance is the fact that in every case shown, the umbrella system that is several hundred percent greater than that provided by just using the standard-type beach umbrella. For the representative examples shown, this value varies from a low of 454 percent to as much as 1320 percent for umbrellas mounted in a vertical position. As shown in Table 4 for an example calculation for a 7" DIA circular type stabilizer disk attached to a 4 lb umbrella system, this percentage of improvement is significantly greater than the listed values of Tables 2 and 3 when the beach umbrella is oriented at larger and larger angles relative to the vertical. At an extreme angle of 60 degs for a disk buried 12" below the surface, this improvement in total static retention force is equivalent to approximately 2000 percent.

TABLE 4

| θ | USING 7" DIA CIRCULAR-TYPE STABILIZER WEIGHT: 4 lb UMBRELLA SYSTEM | | | |
|---|---|---|---|---|
| | DEPTH 8" IN SAND | | DEPTH 12" IN SAND | |
| | TOTAL STATIC RETENTION FORCE | % INCREASE OVER STANDARD-TYPE UMBRELLA SYSTEM | TOTAL STATIC RETENTION FORCE | % INCREASE OVER STANDARD-TYPE UMBRELLA SYSTEM |
| 0° | 28.8 lbs | 720% | 41.3 lbs | 1033% |
| 30° | 28.3 lbs | 808% | 40.8 lbs | 1166% |
| 45° | 27.6 lbs | 986% | 40.1 lbs | 1432% |
| 60° | 26.8 lbs | 1330% | 39.3 lbs | 1965% |

One should note that for the calculations made for TABLES 2, 3 and 4, it was assumed that the net base area of the stabilizer disk was equal to the area of the disk mimus a tare value of 1 sq. inch to approximate the typical projected area of the lower retention force for the standard-type umbrella system is equal to its total weight when vertically oriented, or a component of this weight when oriented at an angle to the vertical. For the stabilizer-type umbrella system, this total static retention force is the sum of the weight, or a component of the weight as appropriate, of the new invented umbrella system, plus the weight of the column of sand directly above the stabilizer disk. Although the latter value varies with the shape and depth of the stabilizer disk, its magnitude is readily calculated from well known principles of mechanics and physics.

In practice, the selection of shape of the stabilizer disk and its dimensions may vary in the final manufactured embodiment, depending on several factors such as storage requirements, and the average wind generated lifting force expected for specific beaches. As a guide as to how this total static retention force changes with the dimensions of the stabilizer disk, calculations have been made for some examples and have been summarized in TABLE 5.

TABLE 5

| SQUARE-STABILIZER SIZE | TOTAL STATIC RETENTION FORCE | % INCREASE OVER STANDARD-TYPE UMBRELLA SYSTEM | TOTAL STATIC RETENTION FORCE | % INCREASE OVER STANDARD-TYPE UMBRELLA SYSTEM |
|---|---|---|---|---|
| 4" × 4" | 16.5 lbs | 413% | 17.4 lbs | 249% |
| 5" × 5" | 26.4 lbs | 660% | 27.9 lbs | 399% |
| 6" × 6" | 38.5 lbs | 963% | 40.7 lbs | 581% |
| 7" × 7" | 52.8 lbs | 1320% | 55.8 lbs | 797% |

a) 4 lb SYSTEM $\theta = 0°$; 12" DEPTH
b) 7 lb SYSTEM: $\theta = 0°$; 12" DEPTH

What is claimed as new is as follows:

1. A stabilizer-retention device for the support rod on a beach umbrella, said stabilizer-retention device comprising an anchor device comprising a thin circular plate having an upwardly facing surface area, means mounting said plate on the lower end of a support rod for a beach umbrella, said plate disposed beneath a surface of sand in a sand cavity with a column of sand positioned on the upwardly facing surface area whereby the column of sand increases the static retention force and lateral stability of the beach umbrella, said means mounting said plate on a lower end of said support rod including an upwardly extending, externally threaded sleeve rigidly mounted on an upper surface of the plate, the support rod having a peripheral shoulder formed by a compressible cylindrical sleeve mounted on the lower end thereof telescoped into the sleeve, a retaining cap having an internally threaded portion engaged with the externally threaded sleeve with the cap including an inwardly extending peripheral flange at an upper end thereof overlying and engaging the shoulder of the compressible sleeve on the support rod thereby compressing it sufficiently for securing the support rod rigidly to the plate.

2. The device of claim 11 wherein said cavity of sand extends beneath the surface of the sand:

said plate being disposed beneath the surface of sand in the cavity with a column of sand in said cavity resting on the upwardly facing surface are of the plate for increasing the static retention force and lateral stability of the beach umbrella.

3. The device as defined in claim 2 wherein the supporting rod for the beach umbrella includes a separable lower section to enable the lower section and plate to be used as a digging implement when forming a sand cavity with the sand cavity being oriented to position the plate in a selected horizontal and angular position with respect to the surface of the sand.

* * * * *